US009797395B2

(12) United States Patent
Urdaneta et al.

(10) Patent No.: US 9,797,395 B2
(45) Date of Patent: Oct. 24, 2017

(54) APPARATUS AND METHODS FOR IDENTIFYING DEFECTIVE PUMPS

(71) Applicant: Schlumberger Technology Corporation, Sugar Land, TX (US)

(72) Inventors: Carlos Urdaneta, Houston, TX (US); Hao Lam, Richmond, TX (US); Rajesh Luharuka, Katy, TX (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 0 days.

(21) Appl. No.: 14/857,148

(22) Filed: Sep. 17, 2015

(65) Prior Publication Data

US 2017/0082101 A1 Mar. 23, 2017

(51) Int. Cl.

| | |
|---|---|
| ***F04B 51/00*** | (2006.01) |
| ***F04B 53/14*** | (2006.01) |
| ***F04B 53/16*** | (2006.01) |
| ***F04B 17/06*** | (2006.01) |
| ***F04B 1/00*** | (2006.01) |
| ***F04B 9/04*** | (2006.01) |
| ***F04B 17/03*** | (2006.01) |
| ***F04B 47/00*** | (2006.01) |
| ***F04B 49/06*** | (2006.01) |

(52) U.S. Cl.

CPC ..... *F04B 51/00* (2013.01); *F04B 1/00* (2013.01); *F04B 9/045* (2013.01); *F04B 17/03* (2013.01); *F04B 17/06* (2013.01); *F04B 47/00* (2013.01); *F04B 49/065* (2013.01); *F04B 53/14* (2013.01); *F04B 53/16* (2013.01); *F04B 2201/1208* (2013.01); *F04B 2205/05* (2013.01)

(58) Field of Classification Search

None

See application file for complete search history.

(56) References Cited

U.S. PATENT DOCUMENTS

| | | | | |
|---|---|---|---|---|
| 5,499,538 A * | 3/1996 | Glidewell | ..... | F02D 41/221 123/479 |
| 5,720,598 A * | 2/1998 | de Chizzelle | ..... | F04B 51/00 417/53 |
| 6,901,791 B1 * | 6/2005 | Frenz | ..... | F02D 41/221 73/114.41 |
| 2011/0189028 A1 * | 8/2011 | Shampine | ..... | F04B 49/06 417/53 |

* cited by examiner

*Primary Examiner* — Andre Allen

(74) *Attorney, Agent, or Firm* — Michael L. Flynn; Rachel E. Greene

(57) ABSTRACT

Apparatus and methods for detecting pump defects in a pumping system comprising multiple pumps. Each pump includes a pump fluid outlet fluidly connected with the pump fluid outlet of the other pumps. Pump defects are detected by generating information related to fluid pressure fluctuations at each pump fluid outlet and determining harmonic frequencies from the information related to fluid pressure fluctuations for each of the plurality of pumps. The amplitude of the harmonic frequencies is indicative of a defective one of the plurality of pumps.

20 Claims, 8 Drawing Sheets

APPARATUS AND METHODS FOR IDENTIFYING DEFECTIVE PUMPS

BACKGROUND OF THE DISCLOSURE

In oilfield operations, reciprocating pumps are utilized at wellsites for large scale, high-pressure operations. Such operations may include drilling, cementing, acidizing, water jet cutting, and hydraulic fracturing of subterranean formations. In some applications, several pumps may be connected in parallel to a single manifold, flow line, or well. Some pumps include reciprocating members driven by a crankshaft toward and away from a fluid chamber to alternatingly draw in, pressurize, and expel fluid from the fluid chamber. Hydraulic fracturing of a subterranean formation, for example, may utilize fluid at a pressure exceeding 10,000 pounds per square inch (PSI).

The success of the pumping operations may be related to many factors, including physical size, weight, failure rates, and safety. Due to high pressures and abrasive properties of certain fluids, sealing components or other portions of the pumps exposed to the fluids may become worn or eroded. Such defects are often detected late, resulting in pump failures during pumping operations and/or in severe damage to the pumps and other equipment. Interruptions in pumping operations may reduce the success and/or efficiency of the pumping operations, effects of which may reduce hydrocarbon production of a well. In some instances, the pumping operations may have to be repeated at substantial monetary costs and loss of production time.

Such consequences make pump maintenance and timely detection of defects a high priority in the oil and gas industry. Some pump health monitoring systems generate false alarms, causing unnecessary pump maintenance and interruptions in pumping operations. In preparation for pump defects and failures, pumping systems often include additional pump assemblies in standby mode, which is a costly measure of preventing interruptions in pumping operations.

SUMMARY OF THE DISCLOSURE

This summary is provided to introduce a selection of concepts that are further described below in the detailed description. This summary is not intended to identify indispensable features of the claimed subject matter, nor is it intended for use as an aid in limiting the scope of the claimed subject matter.

The present disclosure introduces an apparatus that includes a monitoring system operable for detecting pump defects in a pumping system. The pumping system includes multiple pumps, each of the pumps includes a pump fluid outlet, and the pump fluid outlets are fluidly connected. The monitoring system includes multiple pressure sensors and a monitoring device. The pressure sensors are each associated with a corresponding one of the pumps, and are each operable to generate information related to fluid pressure at a corresponding pump fluid outlet. The monitoring device is in communication with the pressure sensors, and is operable to determine harmonic frequencies from the information related to fluid pressure for each of the pumps. Amplitude of the harmonic frequencies is indicative of a defective one of the pumps.

The present disclosure also introduces a method that includes detecting pump defects in a pumping system. The pumping system includes multiple pumps each having a pump fluid outlet, and the pump fluid outlets are fluidly connected. Detecting pump defects includes generating information related to fluid pressure fluctuations at each pump fluid outlet, and determining harmonic frequencies from the information related to fluid pressure fluctuations for each of the pumps. The amplitude of the harmonic frequencies is indicative of a defective one of the pumps.

The present disclosure also introduces a method that includes detecting pump defects in a pumping system that includes a multiplex positive displacement pump having a pump fluid outlet. Detecting pump defects includes monitoring fluid pressure fluctuations at the pump fluid outlet of the pump, determining harmonics for the pump based on fluid pressure fluctuations, and monitoring amplitude of the harmonics for the pump to determine if the pump is defective.

These and additional aspects of the present disclosure are set forth in the description that follows, and/or may be learned by a person having ordinary skill in the art by reading the materials herein and/or practicing the principles described herein. At least some aspects of the present disclosure may be achieved via means recited in the attached claims.

BRIEF DESCRIPTION OF THE DRAWINGS

The present disclosure is understood from the following detailed description when read with the accompanying figures. It is emphasized that, in accordance with the standard practice in the industry, various features are not drawn to scale. In fact, the dimensions of the various features may be arbitrarily increased or reduced for clarity of discussion.

DETAILED DESCRIPTION

Figure 1:
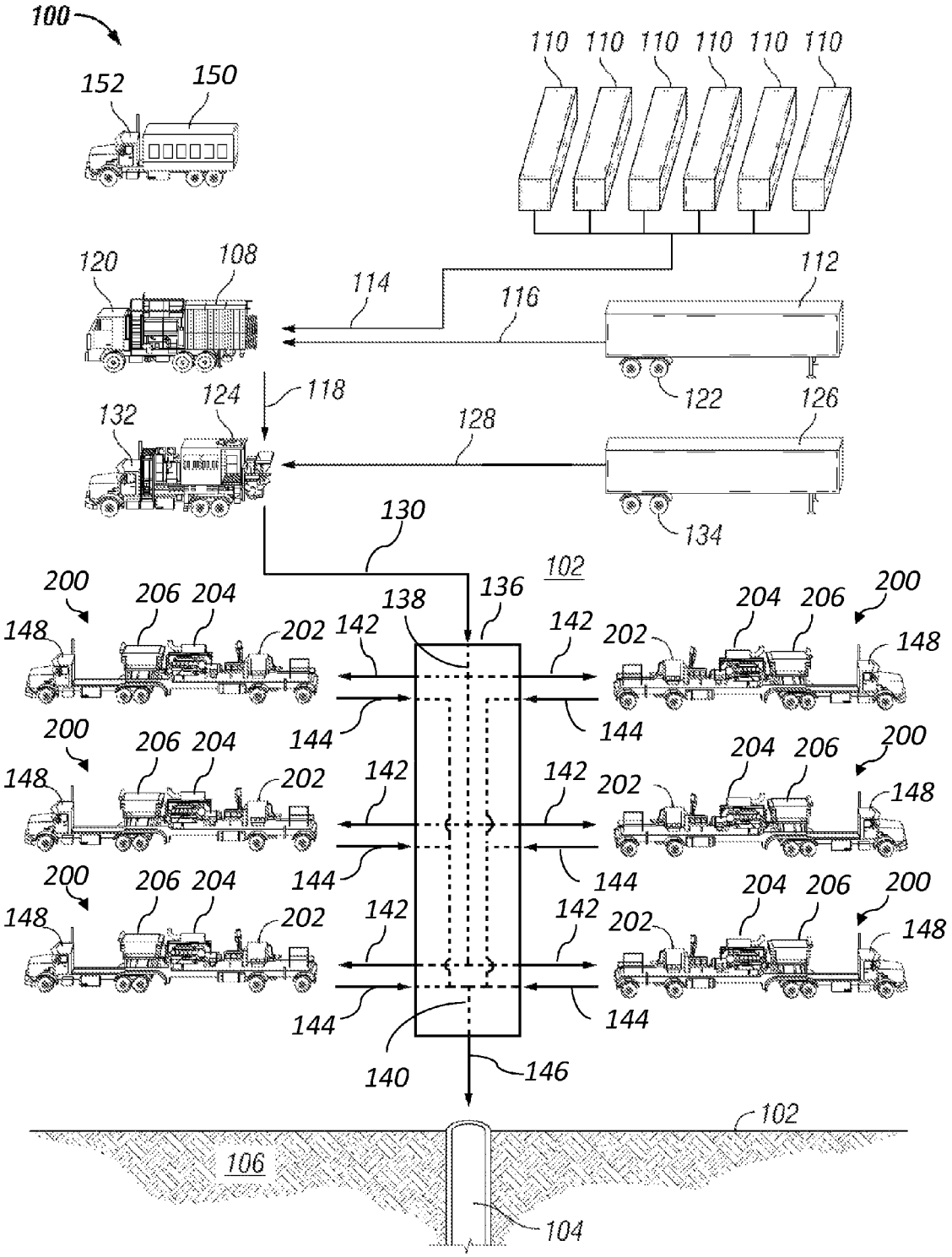
FIG. 1 is a schematic view of at least a portion of an example implementation of apparatus according to one or more aspects of the present disclosure.

It is to be understood that the following disclosure provides many different embodiments, or examples, for implementing different features of various embodiments. Specific examples of components and arrangements are described below to simplify the present disclosure. These are, of course, merely examples and are not intended to be limiting. In addition, the present disclosure may repeat reference numerals and/or letters in the various examples. This repetition is for simplicity and clarity, and does not in itself dictate a relationship between the various embodiments and/or configurations discussed. Moreover, the formation of a first feature over or on a second feature in the description that follows may include embodiments in which the first and second features are formed in direct contact, and may also include embodiments in which additional features may be formed interposing the first and second features, such that the first and second features may not be in direct contact.

FIG. 1 is a schematic view of at least a portion of an example pumping system 100 according to one or more aspects of the present disclosure. The figure depicts a wellsite surface 102 adjacent to a wellbore 104 and a partial sectional view of the subterranean formation 106 penetrated by the wellbore 104 below the wellsite surface 102. The pumping system 100 may comprise a first mixer 108 fluidly connected with one or more tanks 110 and a first container 112. The first container 112 may contain a first material and the tanks 110 may contain a liquid. The first material may be or comprise a hydratable material or gelling agent, such as guar, polymers, synthetic polymers, galactomannan, polysaccharides, cellulose, and/or clay, among other examples, and the liquid may be or comprise an aqueous fluid, which may comprise water or an aqueous solution comprising water, among other examples. The first mixer 108 may be operable to receive the first material and the liquid via two or more fluid conduits 114, 116, and mix or otherwise combine the first material and the liquid to form a base fluid. The base fluid may be or comprise that which is known in the art as a gel. The first mixer 108 may then discharge the base fluid via one or more fluid conduits 118.

The first mixer 108 and the first container 112 may each be disposed on corresponding trucks, trailers, and/or other mobile carriers 120, 122, respectively, such as may permit their transportation to the wellsite surface 102. However, the first mixer 108 and/or first container 112 may be skidded or otherwise stationary, and/or may be temporarily or permanently installed at the wellsite surface 102.

The pumping system 100 may further comprise a second mixer 124 fluidly connected with the first mixer 108 and a second container 126. The second container 126 may contain a second material that may be substantially different than the first material. For example, the second material may be or comprise a proppant material, such as sand, sand-like particles, silica, quartz, and/or propping agents, among other examples. The second mixer 124 may be operable to receive the base fluid from the first mixer 108 via one or more fluid conduits 118, and the second material from the second container 126 via one or more fluid conduits 128, and mix or otherwise combine the base fluid and the second material to form a mixture. The mixture may be or comprise that which is known in the art as a fracturing fluid. The second mixer 124 may then discharge the mixture via one or more fluid conduits 130.

The second mixer 124 and the second container 126 may each be disposed on corresponding trucks, trailers, and/or other mobile carriers 132, 134, respectively, such as may permit their transportation to the wellsite surface 102. However, the second mixer 124 and/or second container 126 may be skidded or otherwise stationary, and/or may be temporarily or permanently installed at the wellsite surface 102.

The mixture may be communicated from the second mixer 124 to a common manifold 136 via the one or more fluid conduits 130. The common manifold 136 may comprise a plurality of valves and diverters, as well as a suction line 138 and a discharge line 140, such as may be operable to direct flow of the mixture in a selected or predetermined manner. The common manifold 136, which may be known in the art as a missile or a missile trailer, may distribute the mixture to a pump fleet, which may comprise a plurality of pump assemblies 200, each comprising a pump 202, a prime mover 204, and a heat exchanger 206. Each pump assembly 200 may receive the mixture from the suction line 138 of the common manifold 136, via one or more fluid conduits 142, and discharge the mixture under pressure to the discharge line 140 of the common manifold 136, via one or more fluid conduits 144. The mixture may then be discharged from the common manifold 136 into the wellbore 104, via one or more fluid conduits 146, perhaps through various valves, conduits, and/or other hydraulic circuitry fluidly connected between the common manifold 136 and the wellbore 104. Each pump 202 of the plurality of pump assemblies 200 may be fluidly connected with the other pumps 202 via the plurality of fluid conduits 144 and the discharge line 140 of the common manifold 136. Each pump 202 of the plurality of pump assemblies 200 may also be fluidly connected with the other pumps 202 via the plurality of fluid conduits 142 and the suction line 138 of the common manifold 136.

The pump assemblies 200 may each be mounted on corresponding trucks, trailers, and/or other mobile carriers 148, such as may permit their transportation to the wellsite surface 102. However, the pump assemblies 200 may be skidded or otherwise stationary, and/or may be temporarily or permanently installed at the wellsite surface 102.

The pump assemblies 200 shown in FIG. 1 may comprise pumps 202 having a substantially same or similar structure and/or function, although other implementations within the scope of the present disclosure may include different types and/or sizes of pumps 202. Although the pump fleet of the pumping system 100 is shown comprising six pump assemblies 200, each disposed on a corresponding mobile carrier 148, pump fleets comprising other quantities of pump assemblies 200 are also within the scope of the present disclosure.

The pumping system 100 may also comprise a control/power center 150, such as may be operable to provide control and/or centralized electric power distribution to one or more portions of the pumping system 100. The control/power center 150 may be or comprise an engine-generator set, such as may include a gas turbine generator, an internal combustion engine generator, and/or other sources of electric power. Electric power and/or control signals may be communicated between the control/power center 150 and other wellsite equipment via electric conductors (not shown). However, other means of signal communication, such as wireless communication, are also within the scope of the present disclosure.

The control/power center 150 may be operable to control power distribution between a source of electric power and the first mixer 108, the second mixer 124, the pump assemblies 200, and other pumps and/or conveyers (not shown), such as may be operable to move the fluids, materials, and/or mixtures described above. The control/power center 150 may be employed to monitor and control at least a portion of the pumping system 100 during pumping operations. For example, the control/power center 150 may be operable to monitor and/or control the production rate of the mixture, such as by increasing or decreasing the flow of the liquid from the tanks 110, the first material from the first container 112, the base fluid from the first mixer 108, the second material from the second container 126, and/or the mixture from the second mixer 124. The control/power center 150 may also be operable to monitor and control operational parameters of each pump assembly 200, such as operating frequency or speed, phase or rotational position, temperature, and pressure. The control/power center 150 may also be operable to monitor health and/or functionality of the pump assemblies 200.

The control/power center 150 may be disposed on a corresponding truck, trailer, and/or other mobile carrier 152, such as may permit its transportation to the wellsite surface 102. However, the control/power center 150 may be skidded or otherwise stationary, and/or may be temporarily or permanently installed at the wellsite surface 102.

FIG. 1 shows the pumping system 100 operable to produce and/or mix fluids and/or mixtures that may be pressurized and individually or collectively injected into the wellbore 104 during hydraulic fracturing of the subterranean formation 106. However, it is to be understood that the pumping system 100 may be operable to mix and/or produce other mixtures and/or fluids that may be pressurized and individually or collectively injected into the wellbore 104 during other oilfield operations, such as drilling, cementing, acidizing, chemical injecting, and/or water jet cutting operations, among other examples.

Figure 2:
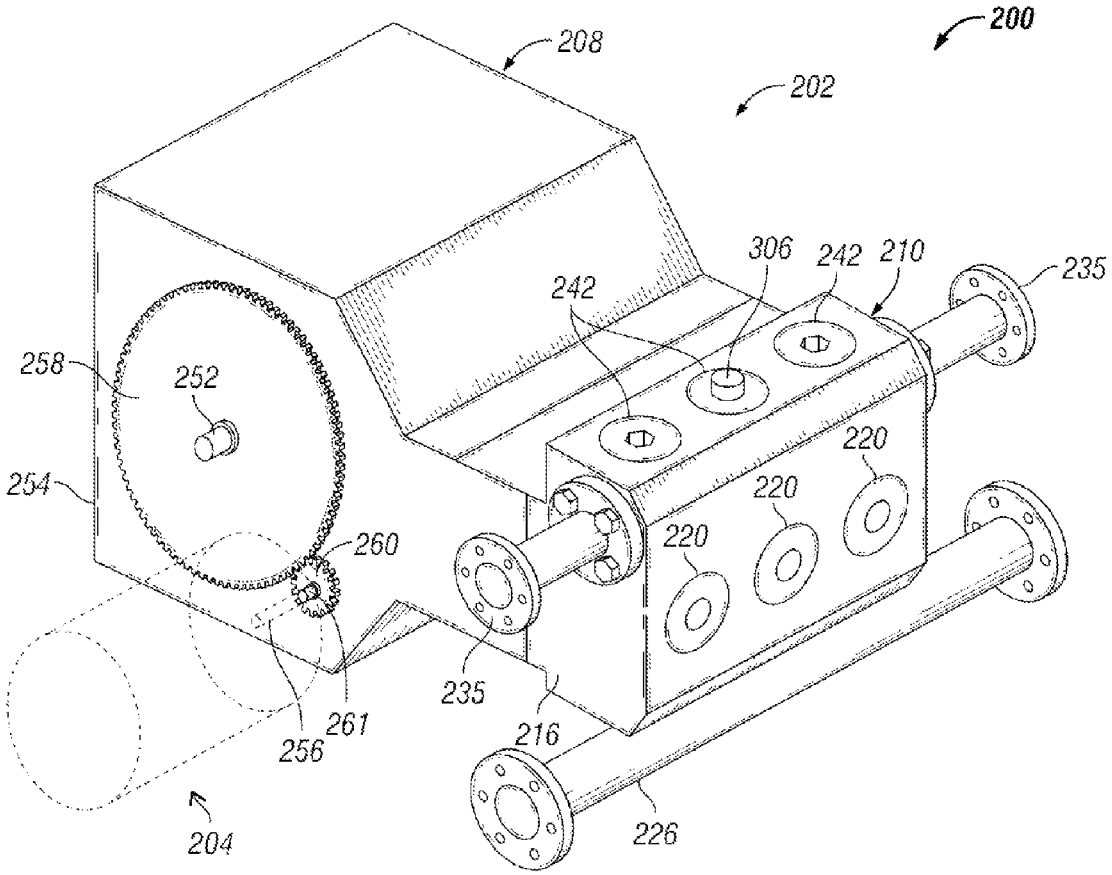
FIG. 2 is a perspective view of an example implementation of a portion of the apparatus shown in FIG. 1 according to one or more aspects of the present disclosure.
Figure 3:
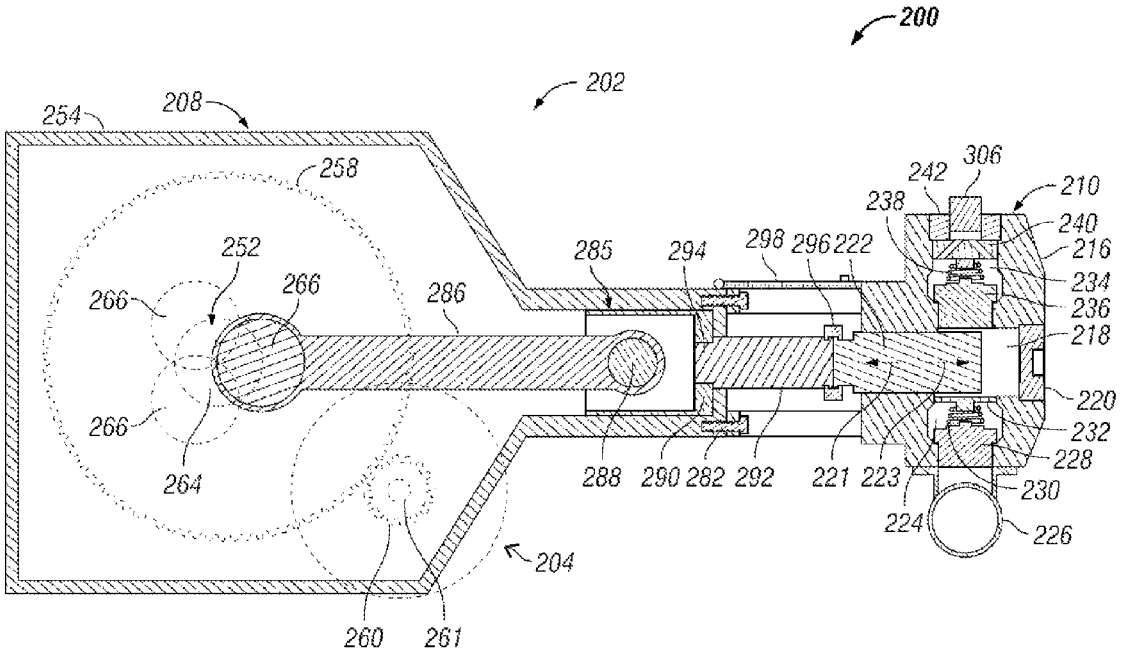
FIG. 3 is a side sectional view of an example implementation of the apparatus shown in FIG. 2 according to one or more aspects of the present disclosure.

FIG. 2 is a perspective view of a portion of an example implementation of one pump assembly 200 shown in FIG. 1 according to one or more aspects of the present disclosure. FIG. 3 is a side sectional view of a portion of the pump assembly 200 shown in FIG. 2. The following description refers to FIGS. 1-3, collectively.

The pump assembly 200 may comprise a fixed-displacement reciprocating pump 202 operatively coupled with the prime mover 204. The pump 202 comprises a power section 208 and a fluid section 210. The fluid section 210 may comprise a pump housing 216 having a plurality of fluid chambers 218. One end of each fluid chamber 218 may be plugged by a cover plate 220, such as may be threadedly engaged with the pump housing 216. The opposite end of each fluid chamber 218 contains a reciprocating member 222 slidably disposed therein and operable to displace a fluid within the corresponding fluid chamber 218. Although the reciprocating member 222 is depicted as a plunger, the reciprocating member 222 may also be implemented as a piston, diaphragm, or another reciprocating fluid displacing member.

Each fluid chamber 218 is fluidly connected with a corresponding one of a plurality of fluid inlet cavities 224 each adapted for communicating fluid from a fluid inlet conduit 226 into a corresponding fluid chamber 218. The fluid inlet conduit 226 may be or comprise at least a portion of the one or more fluid conduits 142 and/or may otherwise be in fluid communication with the suction line 138 of the common manifold 136.

Each fluid inlet cavity 224 contains an inlet valve 228 operable to control fluid flow from the fluid inlet conduit 226 into the fluid chamber 218. Each inlet valve 228 may be biased toward a closed position by a first spring 230, which may be held in place by an inlet valve stop 232. Each inlet valve 228 may be actuated to an open position by a selected or predetermined differential pressure between the corresponding fluid inlet cavity 224 and the fluid inlet conduit 226.

Each fluid chamber 218 is also fluidly connected with a fluid outlet cavity 234 extending through the pump housing 216 transverse to the reciprocating members 222. The fluid outlet cavity 234 is adapted for communicating pressurized fluid from each fluid chamber 218 into one or more fluid outlet conduits 235. Each fluid outlet conduit 235 may be or comprise at least a portion of the one or more fluid conduits 144 and/or may otherwise be in fluid communication with the discharge line 140 of the common manifold 136, such as may facilitate injection of the fluid into the wellbore 104 during oilfield operations.

The fluid section 210 also contains a plurality of outlet valves 236 each operable to control fluid flow from a corresponding fluid chamber 218 into the fluid outlet cavity 234. Each outlet valve 236 may be biased toward a closed position by a second spring 238, which may be held in place by an outlet valve stop 240. Each outlet valve 236 may be actuated to an open position by a selected or predetermined differential pressure between the corresponding fluid chamber 218 and the fluid outlet cavity 234. The fluid outlet cavity 234 may be plugged by cover plates 242, such as may be threadedly engaged with the pump housing 216, and one or both ends of the fluid outlet cavity 234 may be fluidly coupled with the one or more fluid outlet conduits 235.

During pumping operations, portions of the power section 208 of the pump assembly 200 rotate in a manner that generates a reciprocating linear motion to move the reciprocating members 222 longitudinally within the corresponding fluid chambers 218, thereby alternatingly drawing and displacing the fluid within the fluid chambers 218. With regard to each reciprocating member 222, as the reciprocating member 222 moves out of the fluid chamber 218, as indicated by arrow 221, the pressure of the fluid inside the corresponding fluid chamber 218 decreases, thus creating a differential pressure across the corresponding fluid inlet valve 228. The pressure differential operates to compress the first spring 230, thus actuating the fluid inlet valve 228 to an open position to permit the fluid from the fluid inlet conduit 226 to enter the corresponding fluid inlet cavity 224. The fluid then enters the fluid chamber 218 as the reciprocating member 222 continues to move longitudinally out of the fluid chamber 218 until the pressure difference between the fluid inside the fluid chamber 218 and the fluid within the fluid inlet conduit 226 is low enough to permit the first spring 230 to actuate the fluid inlet valve 228 to the closed position. As the reciprocating member 222 begins to move longitudinally back into the fluid chamber 218, as indicated by arrow 223, the pressure of the fluid inside of fluid chamber 218 begins to increase. The fluid pressure inside the fluid chamber 218 continues to increase as the reciprocating member 222 continues to move into the fluid chamber 218 until the pressure of the fluid inside the fluid chamber 218 is high enough to overcome the pressure of the fluid inside the fluid outlet cavity 234 and compress the second spring 238, thus actuating the fluid outlet valve 236 to the open position and permitting the pressurized fluid to move into the fluid outlet cavity 234 and the fluid outlet conduit 235. Thereafter, the fluid may be communicated to the common manifold 136 and the wellbore 104 or to another destination.

The fluid flow rate generated by the pump assembly 200 may depend on the physical size of the reciprocating members 222 and fluid chambers 218, as well as the pump operating speed, which may be defined by the speed or rate at which the reciprocating members 222 cycle or move within the fluid chambers 218. The speed or rate at which the reciprocating members 222 move may be related to the rotational speed of the power section 208. Accordingly, the fluid flow rate may be controlled by the rotational speed of the power section 208.

The pump assembly 200 may comprise a prime mover 204 operatively coupled with a drive shaft 252 enclosed and maintained in position by a power section housing 254, such that the prime mover 204 is operable to drive or otherwise rotate the drive shaft 252. The prime mover 204 may comprise a rotatable output shaft 256 operatively connected with the drive shaft 252 by a transmission or gear train, which may comprise a spur gear 258 coupled with the drive shaft 252 and a pinion gear 260 coupled with a support shaft 261. The output shaft 256 and the support shaft 261 may be coupled, such as may facilitate transfer of torque from the prime mover 204 to the support shaft 261, the pinion gear 260, the spur gear 258, and the drive shaft 252. To prevent relative rotation between the power section housing 254 and the prime mover 204, the power section housing 254 and prime mover 204 may be fixedly coupled together or to a common base, such as a trailer of the mobile carrier 148. The prime mover 204 may comprise an engine, such as a gasoline engine or a diesel engine, an electric motor, such as a synchronous or asynchronous electric motor, including a synchronous permanent magnet motor, a hydraulic motor, or another prime mover operable to rotate the drive shaft 252.

Figure 4:
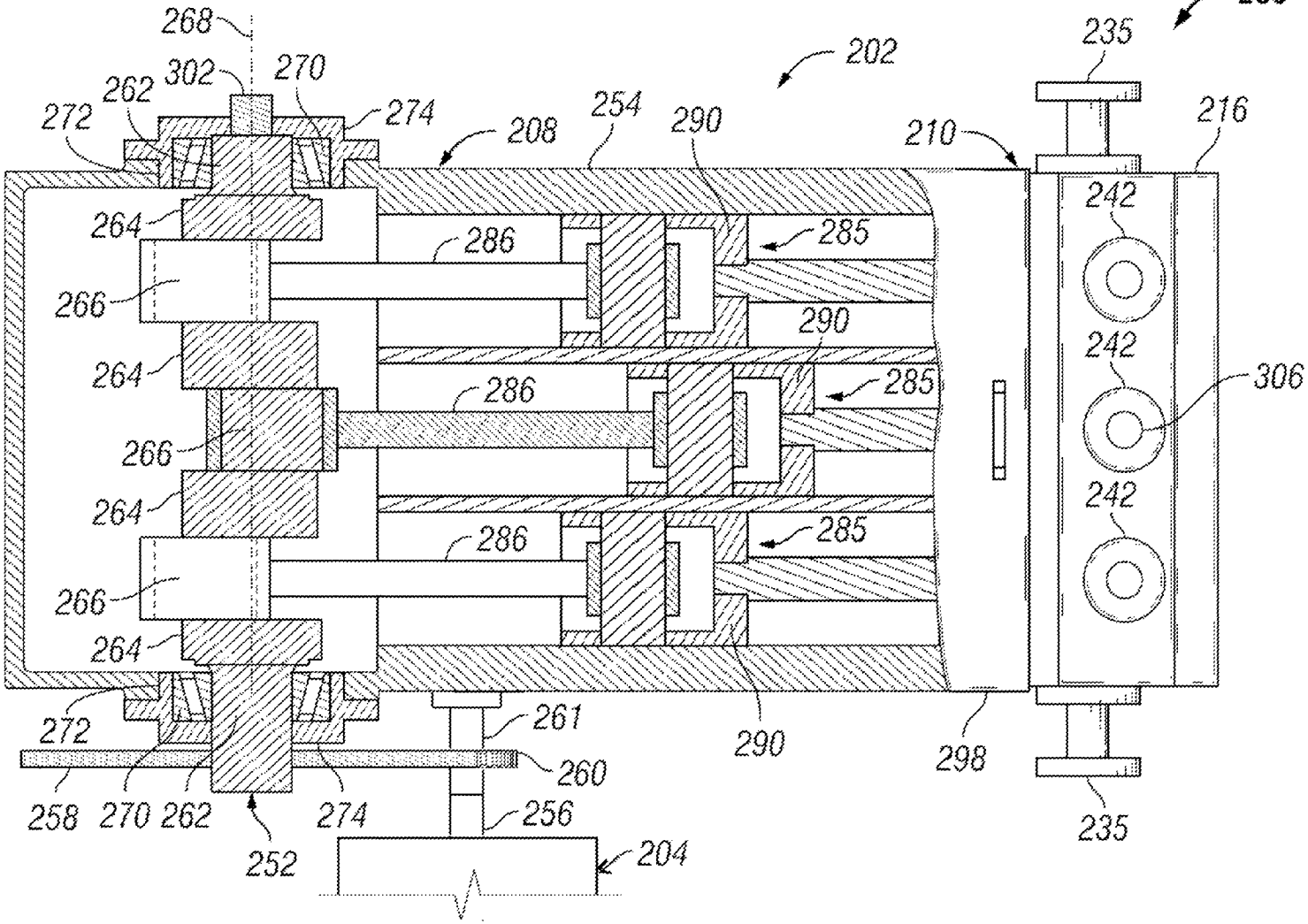
FIG. 4 is a top partial sectional view of an example implementation of the apparatus shown in FIG. 2 according to one or more aspects of the present disclosure.

FIG. 4 is a top partial sectional view of a portion of an example implementation of the pump assembly 200 shown in FIGS. 2 and 3 according to one or more aspects of the present disclosure. Referring to FIGS. 3 and 4, collectively, the drive shaft 252 may be implemented as a crankshaft comprising a plurality of support journals 262, main journals 264, and crankpin journals 266. The support and main journals 262, 264 may extend along a central axis of rotation 268 of the drive shaft 252, while the crankpin journals 266 may be offset from the central axis of rotation 268 by a selected or predetermined distance and spaced 120 degrees apart with respect to the support journals 262 and main journals 264. The drive shaft 252 may be supported in position within the power section 208 by the power section housing 254, wherein the support journals 262 may extend through opposing openings 272 in the power section housing 254. To facilitate rotation of the drive shaft 252 within the power section housing 254, one or more bearings 270 may be disposed about the support journals 262 and against the side surfaces of the openings 272. A cover plate and/or other means for protection 274 may enclose the bearings 270.

The power section 208 and the fluid section 210 may be coupled or otherwise connected together. For example, the pump housing 216 may be fastened with the power section housing 254 by a plurality of threaded fasteners 282. The pump assembly 200 may further comprise an access door 298, which may facilitate access to portions of the pump 202 located between the power section 208 and the fluid section 210, such as during assembly and/or maintenance of the pump 202.

To transform and transmit the rotational motion of the drive shaft 252 to a reciprocating linear motion of the reciprocating members 222, a plurality of crosshead mechanisms 285 may be utilized. For example, each crosshead mechanism 285 may comprise a connecting rod 286 pivotally coupled with a corresponding crankpin journal 266 at one end and with a pin 288 of a crosshead 290 at an opposing end. During pumping operations, walls and/or interior portions of the power section housing 254 may guide each crosshead 290, such as may reduce or eliminate lateral motion of each crosshead 290. Each crosshead mechanism 285 may further comprise a piston rod 292 coupling the crosshead 290 with the reciprocating member 222. The piston rod 292 may be coupled with the crosshead 290 via a threaded connection 294 and with the reciprocating member 222 via a flexible connection 296.

Although FIGS. 2-4 show the pump assembly 200 comprising a triplex reciprocating pump 202 comprising three fluid chambers 218 and three reciprocating members 222, other implementations within the scope of the present disclosure may include the pump 202 as or comprising a quintuplex reciprocating pump comprising five fluid chambers 218 and five reciprocating members 222, or other quantities of fluid chambers 218 and reciprocating members 222. It is further noted that the pump 202 described above and shown in FIGS. 2-4 is merely an example, and that other pumps, such as diaphragm pumps, gear pumps, external circumferential pumps, internal circumferential pumps, lobe pumps, and other positive displacement pumps, are also within the scope of the present disclosure.

Figure 5:
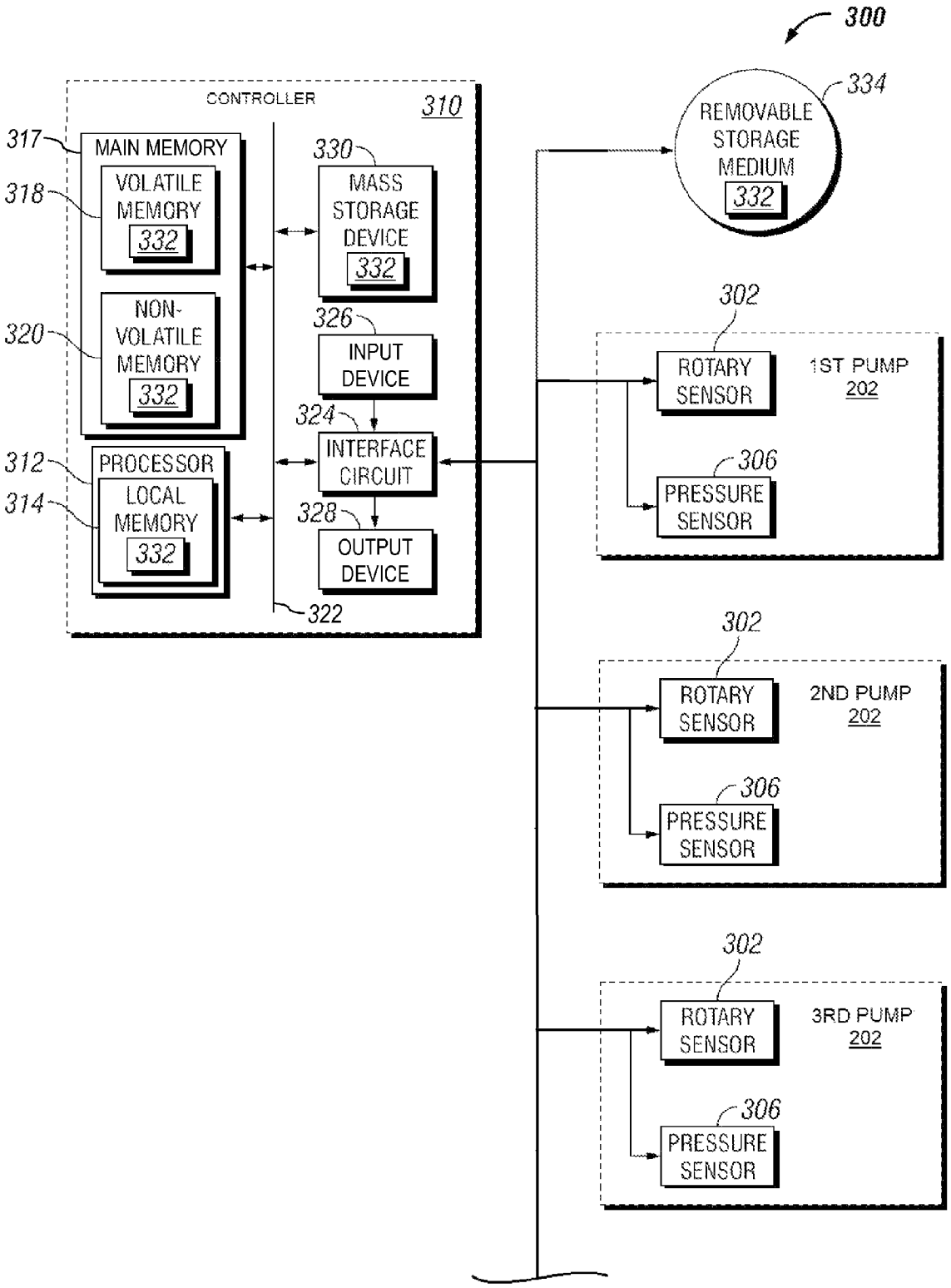
FIG. 5 is a schematic view of at least a portion of an example implementation of apparatus according to one or more aspects of the present disclosure.

The pumping system 100 shown in FIG. 1 may further comprise a monitoring and control system 300 (hereinafter referred to as a control system), which may be operable to monitor and/or control operating parameters of the pumping system 100. FIG. 5 is a schematic view of at least a portion of an example implementation of the control system 300 according to one or more aspects of the present disclosure. The control system 300 may monitor the pumps 202 via a plurality of position sensors, which may generate signals or information related to the rotational phase, position, and/or speed of the pumps 202. The following description refers to FIGS. 1-5, collectively.

The position sensors may comprise one or more rotary sensors 302 each associated with a corresponding pump 202. Each rotary sensor 302 may be operable to generate information related to rotational position or phase and/or rotational speed or operating frequency of the corresponding pump 202. For example, one or more of the rotary sensors 302 may be operable to convert angular position or motion of the drive shaft 252 or another rotating component of the power section 208 to an electrical signal, such as to indicate phase and speed (i.e., frequency) of the pump 202, or may otherwise be operable to generate an electrical signal related to the angular position or motion of the drive shaft 252 or another rotating component of the power section 208. Each rotary sensor 302 may be disposed adjacent an external portion of the corresponding drive shaft 252, such as the support journals 262 or other rotating members of the power section 208, and may be supported by the power section housing 254, the cover plate 274, or another portion of the corresponding power section 208. Each rotary sensor 302 may be or comprise an encoder, a rotary potentiometer, a synchro, a resolver, and/or a rotary variable differential transformer (RVDT), among other examples. The rotary sensors 302 may generate frequency signals ranging between about zero volts DC and about 24 volts DC, although rotary sensors that generate other signals are also within the scope of the present disclosure.

The control system 300 may further comprise a plurality of pressure sensors 306 each associated with a corresponding pump 202. Each pressure sensor 306 may be operable to measure fluid pressure fluctuations at the fluid outlet of the corresponding pump 202 and convert the fluid pressure to an electrical signal or otherwise generate an electrical signal related to the fluid pressure fluctuations. Each pressure sensor 306 may extend through one of the cover plates 242 or other portions of the corresponding pump housing 216 or otherwise be disposed relative to the fluid outlet cavity 234 to measure pressure fluctuations at the corresponding pump outlet. Each pressure sensor 306 may be a high-pressure sensor operable to sense pressure between about zero PSI and about 15,000 PSI, although other pressure sensors with other pressure ratings are also within the scope of the present disclosure. Each pressure sensor 306 may generate an output signal ranging between about four milliamps (mA) and about twenty mA and/or between about zero volts DC and about ten volts DC, although pressure sensors that generate other signals are also within the scope of the present disclosure.

The control system 300 also comprises a monitoring and control device 310 (hereinafter referred to as a controller) in communication with the rotary sensors 302 and/or the pressure sensors 306. The controller 310 may be operable to execute example machine-readable instructions to implement at least a portion of one or more of the methods and/or processes described herein, and/or to implement a portion of one or more of the example apparatus/systems described herein. The controller 310 may be or comprise, for example, one or more general- or special-purpose processors, computing devices, servers, personal computers, personal digital assistant (PDA) devices, smartphones, internet appliances, and/or other types of computing devices. The controller 310 may be implemented as part of the control/power center 150.

The controller 310 may comprise a processor 312, such as a general-purpose programmable processor. The processor 312 may comprise a local memory 314, and may execute coded instructions 332 present in the local memory 314 and/or another memory device. The processor 312 may execute, among other things, machine-readable instructions or programs to implement the methods and/or processes described herein. The programs stored in the local memory 314 may include program instructions or computer program code that, when executed by the processor 312, facilitate performing the methods and/or processes described herein, such as in conjunction with operation of the prime movers 204 and sensors 302, 306, including for the identification of defects associated with the pumps 202 and/or other components of the pump assemblies 200. The processor 312 may be, comprise, or be implemented by one or a plurality of processors of various types suitable to the local application environment, and may include one or more of general- and/or special-purpose computers, microprocessors, digital signal processors (DSPs), field-programmable gate arrays (FPGAs), application-specific integrated circuits (ASICs), and processors based on a multi-core processor architecture, as non-limiting examples. Other processors from other families are also appropriate.

The processor 312 may be in communication with a main memory 317, such as via a bus 322 and/or other communication means. The main memory 317 may comprise a volatile memory 318 and a non-volatile memory 320. The volatile memory 318 may be, comprise, or be implemented by random access memory (RAM), static random access memory (SRAM), synchronous dynamic random access memory (SDRAM), dynamic random access memory (DRAM), RAMBUS dynamic random access memory (RDRAM), and/or other types of random access memory devices. The non-volatile memory 320 may be, comprise, or be implemented by read-only memory, flash memory, and/or other types of memory devices. One or more memory controllers (not shown) may control access to the volatile memory 318 and/or non-volatile memory 320. The controller 310 may be operable to store or record the signals or other information generated by the sensors 302, 306 on the main memory 317.

The controller 310 may also comprise an interface circuit 324. The interface circuit 324 may be, comprise, or be implemented by various types of standard interfaces, such as an Ethernet interface, a universal serial bus (USB), a third generation input/output (3GIO) interface, a wireless interface, and/or a cellular interface, among others. The interface circuit 324 may also comprise a graphics driver card. The interface circuit 324 may also comprise a communication device, such as a modem or network interface card to facilitate exchange of data with external computing devices via a network (e.g., Ethernet connection, digital subscriber line (DSL), telephone line, coaxial cable, cellular telephone system, satellite, etc.). The sensors 302, 306 may be connected with the controller 310 via the interface circuit 324, such as may facilitate communication between the sensors 302, 306 and the controller 310.

One or more input devices 326 may also be connected to the interface circuit 324. The input devices 326 may permit an operator to enter data and commands into the processor 312, such as the selected or predetermined phase difference, speed, flow, and/or pressure parameters described herein. The input devices 326 may be, comprise, or be implemented by a keyboard, a mouse, a touchscreen, a track-pad, a trackball, an isopoint, and/or a voice recognition system, among other examples. One or more output devices 328 may also be connected to the interface circuit 324. The output devices 328 may be, comprise, or be implemented by display devices (e.g., a liquid crystal display (LCD) or cathode ray tube display (CRT), among others), printers, and/or speakers, among other examples.

The controller 310 may also comprise one or more mass storage devices 330 for storing machine-readable instructions and data. Examples of such mass storage devices 330 include floppy disk drives, hard drive disks, compact disk (CD) drives, and digital versatile disk (DVD) drives, among others. The coded instructions 332 may be stored in the mass storage device 330, the volatile memory 318, the non-volatile memory 320, the local memory 314, and/or on a removable storage medium 334, such as a CD or DVD.

The modules and/or other components of the controller 310 may be implemented in accordance with hardware (embodied in one or more chips including an integrated circuit, such as an ASIC), or may be implemented as software or firmware for execution by a processor. In the case of firmware or software, the implementation may be provided as a computer program product including a computer-readable medium or storage structure embodying computer program code (i.e., software or firmware) thereon for execution by the processor 312.

During operations of the pumping system 100, the pumps 202 may discharge pressurized fluid in an oscillating manner caused by, for example, the oscillating movement of the reciprocating members 222, resulting in cyclical pressure fluctuations at the outlet of each pump 202. Because certain pump defects may change the profile of the pressure fluctuations, such defects may be detected by examining the pressure fluctuations and/or profiles.

Accordingly, the controller 310 may be operable as a spectrum analyzer that processes the signals generated by the pressure sensors 306, converts the signals from a time domain to a frequency domain, and determines or identifies harmonic frequencies of the pressure fluctuations (hereinafter referred to as harmonics). The harmonics occur at integer multiples of the pump operating speed or frequency (i.e., fundamental frequency). The harmonics may be determined by transforming the pressure fluctuations in the time domain into the frequency domain utilizing one or more transforms. Such transforms may include the Continuous Fourier transform, the Discrete Fast Fourier transform, the Hilbert transform, the Laplace transform, and/or the Maximum Entropy Method, among other examples. The controller 310 may be operable to utilize the one or more transforms to perform the time domain to frequency domain conversion described above.

The control system 300 is operable to detect defects in one or more of the pumps 202 based on the operating speed or frequency of each pump 202, which is indicated by the electrical signals generated by the rotary sensors 302, and the pressure fluctuations generated by each pump 202, which are indicated by the electrical signals generated by the pressure sensors 306. The information related to pressure fluctuations generated by the pressure sensors 306 may be utilized to determine the pump harmonics, as described above. If a first order harmonic (i.e., fundamental harmonic) corresponds to the pumping frequency, the presence of just $M^{th}$ order harmonics associated with a pump 202 may indicate that the pump 202 is properly functioning or otherwise healthy, where M is the product of N and i (i.e., N×i), N is the number of reciprocating members 222 (or displacement chambers 218) of the pump 202, and i is an integer. The presence of harmonics other than the $M^{th}$ order harmonics may indicate that the pump 202 is functioning improperly or otherwise defective. A defective pump 202 may include a failed or failing pump that has a leaking inlet valve 228, a leaking outlet valve 236, a leaking seal, an improperly primed fluid chamber 218, and/or other defects that, for example, may cause unintended pressure drops. The controller 310 may also be operable to determine and/or compare relative amplitudes of the harmonics measured at different pumps 202 to identify which pump 202 is defective. The controller 310 may also or instead be operable to determine the phase difference or tracking between the harmonics and the pump phase or rotational position to identify which pump 202 is defective.

Figure 6:
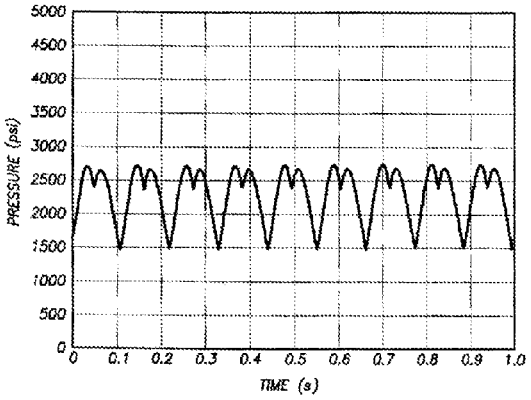
FIGS. 6-13 are graphs related to one or more aspects of the present disclosure.
Figure 7:
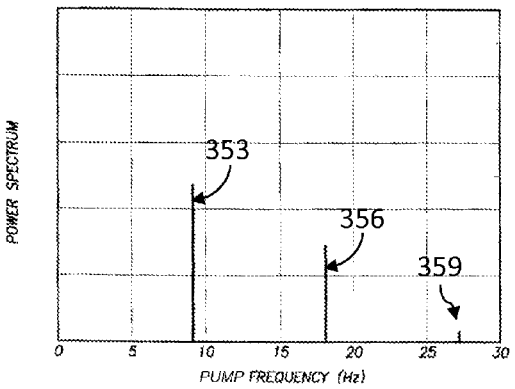

FIG. 6 is a graph depicting example pressure fluctuation information generated by one of the pressure sensors 306 associated with one of the pumps 202 shown in FIG. 1 in an implementation in which the pump 202 is a healthy triplex pump operating at a frequency of 180 RPM, or 3 cycles per second (Hz), and at a pressure ranging between about 1,500 PSI and about 2,700 PSI. The pressure fluctuation information is plotted with respect to time, during a period of operation of one second. As described above, the controller 310 may transform such pressure fluctuation information from the time domain to the frequency domain. FIG. 7 is a graph depicting the results of such transformation of the pressure fluctuation information of FIG. 6 from the time domain to the frequency domain.

The first order harmonic corresponds to 3 Hz, the fundamental frequency of the pump 202. The second order harmonic occurs at twice the pump frequency, and the third order harmonic occurs at three times the pump frequency. In the case of the healthy triplex pump 202, the first and second order harmonics are not apparent in the frequency domain. Thus, in the example shown in FIG. 7, a first observed frequency power spike 353 is found at the third order harmonic, at a frequency of 9 Hz. FIG. 7 also depicts a frequency power spike 356 at the sixth order harmonic, at a frequency of 18 Hz, and another frequency power spike 359 at the ninth order harmonic, at a frequency of 27 Hz. A healthy triplex pump 202 will not exhibit frequency power spikes at the first and second order harmonics, the fourth and fifth order harmonics, the seventh and eighth order harmonics, and the like.

Figure 8:
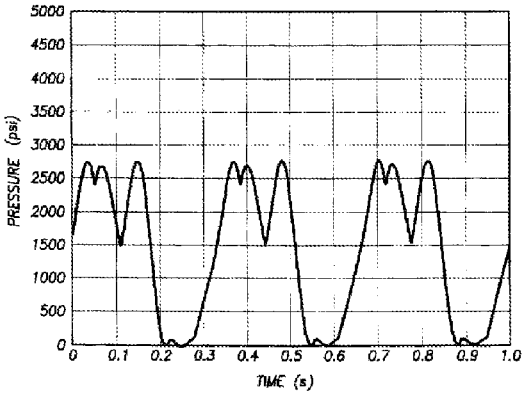
Figure 9:
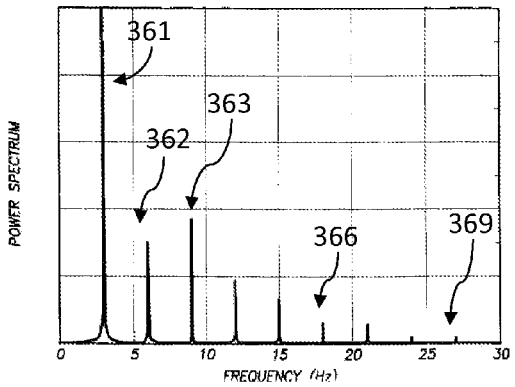

FIG. 8 is a graph showing example pressure fluctuation information generated by one of the pressure sensors 306 associated with one of the pumps 202 shown in FIG. 1 in an implementation in which the pump 202 is a defective triplex pump also operating at a frequency of 180 RPM, or 3 Hz, and at a pressure ranging between about 1,500 PSI and about 2,700 PSI. The defective pump 202 associated with the pressure fluctuation information depicted in FIG. 8 has a defect (such as those described above) causing the sensed pressure to drop to about zero PSI at about 0.2 seconds and thereafter at intervals of about 0.35 seconds. FIG. 9 is a graph depicting the pressure fluctuation information of FIG. 8 after being transformed (such as by the controller 310) from the time domain to the frequency domain.

FIG. 8 shows an example pressure curve generated by a pressure sensor associated with a single isolated pump pumping against a restriction. The depicted pressure curve merely illustrates the mechanism of a pump failure where one of the reciprocating members is not generating flow due to a failed component, thus resulting in a presence of first and second order harmonics and their multiples. It is to be understood that when multiple interconnected pumps are simultaneously pumping fluid into a well that provides a near-constant backpressure, the pressure curve generated by the pressure sensor may not comprise pressure spikes and/or pressure drops as dramatic as those depicted in FIG. 8. Hence, an operator may not be able to perceive a pump failure, associate such pump failure with a particular pump, or, if the failed pump is identified, perceive which portion or component of the pump has failed by simply observing the waveform of the pressure curve.

Similar to the transformation results depicted in FIG. 7, the transformation results depicted in FIG. 9 include a frequency power spike 363 at the third order harmonic, at 9 Hz, a frequency power spike 366 at the sixth order harmonic, at 18 Hz, and a frequency power spike 369 at the ninth order harmonic, at 27 Hz. However, the transformation results depicted in FIG. 9 also include a frequency power spike 361 at the first order harmonic, at 3 Hz, and a frequency power spike 362 at the second order harmonic, at 6 Hz, among other spikes at higher order harmonics (not numbered). The presence of the frequency power spikes 361 and 362 at the first and second order harmonics, respectively, is indicative of a pump defect.

That is, the presence of frequency power spikes at just the $M^{th}$ order harmonics (such as corresponding to the spikes 353, 356, and 359 shown in FIG. 7), and not at the first or second order harmonics (among others), is indicative of healthy pumps, while the presence of frequency power spikes at the first or second order harmonics (such as corresponding to the spikes 361 and 362 shown in FIG. 9) indicates that a pump is defective. To detect when a pump has become defective, the absence/presence of frequency power spikes at the first or second order harmonics may be determined by visual inspection by a human operator. A controller (such as the controller 310 shown in FIG. 5) may also or instead automatically detect the absence/presence of frequency power spikes at the first or second order harmonics.

However, the mere detection that one of the pumps of a pumping system is defective may not be sufficient, because there still remains the question of which of the pumps is defective. That is, the pumping system 100 shown in FIG. 1, among other example pumping systems within the scope of the present disclosure, comprises multiple pumps fluidly connected by a common manifold, common fluid conduits, and/or other fluid circuitry. In such systems, differentiating between healthy and defective pumps can be problematic when the pumps operate at substantially similar frequencies. For example, if the pumping rates of two or more pumps differ by less than 0.5 barrels per minute, determining which pump is generating behavior indicative of a defect can be difficult due, for example, to instantaneous variation in the operating speeds of the pumps. That is, the interconnection of the pumps by a common manifold or other fluid circuitry permits the pressure sensors of the healthy pumps to sense the pressure fluctuations of the defective pump. In this context, the present disclosure introduces monitoring the frequency power at the first and second order harmonics to distinguish the defective pump from the healthy pumps.

That is, while the pressure sensors at each of the pumps will sense the pressure fluctuations attributable to the defect in the defective pump, the first and second order harmonics frequency power determined utilizing the pressure fluctuation information collected from the pressure sensor of the defective pump will be greater than the first and second order harmonics frequency power determined utilizing the pressure fluctuation information collected from each of the pressure sensors of the healthy pumps. The power determined utilizing the pressure fluctuation information collected from the sensor of the defective pump is greater because the pressure sensor of the defective pump senses the defect-caused pressure fluctuations at the defective pump, whereas the pressure sensors of the healthy pumps sense the defect-caused pressure fluctuations at the healthy pumps after the defect-caused pressure fluctuations have traversed the various lengths and bends of piping that interconnect the healthy pumps with the defective pump, such that the defect-caused pressure fluctuations become attenuated as they travel from the defective pump to the pressure sensors of the healthy pumps.

Figure 10:
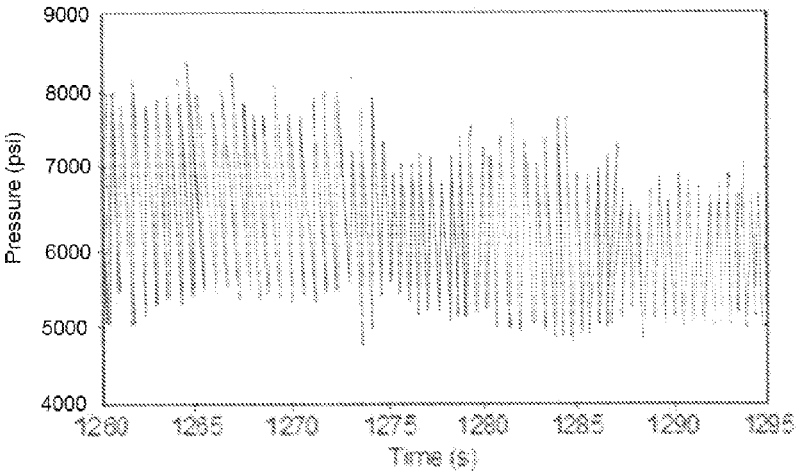

FIG. 10 is a graph depicting another example of information related to pressure fluctuations sensed by one of the pressure sensors 306 associated with a corresponding pump 202 of the pumping system 100. The pressure fluctuation information depicted in FIG. 10 is an example of the information that may be monitored and/or generated by the controller 310 based on the pressure fluctuations of the pump 202 that are sensed by the corresponding pressure sensor 306. The controller 310 also monitors or generates similar information (not shown) based on the pressure fluctuations of the other pumps 202 that are sensed by corresponding other ones of the pressure sensors 306. In this example, each of the pumps 202, including the one represented by the pressure fluctuation information depicted in FIG. 10, is operating at about 212 RPM, or about 3.53 Hz, and between about 5,000 PSI and about 8,000 PSI.

As described above, because the fluid outlet cavities 234 of the pumps 202 are fluidly connected via the fluid conduits 142, 144, 226, and 235 and the suction and discharge lines 138 and 140 of the common manifold 136, the pressure fluctuations generated by a defective one of the pumps 202 may be detected by each pressure sensor 306 associated with each of the plurality of pumps 202. To identify which pump 202 is defective, the pressure fluctuation information generated by each of the pressure sensors 306 may be transformed to the frequency domain by the controller 310, as described above, and the harmonics may be determined and/or plotted as a function of time for each of the pumps 202.

Figure 11:
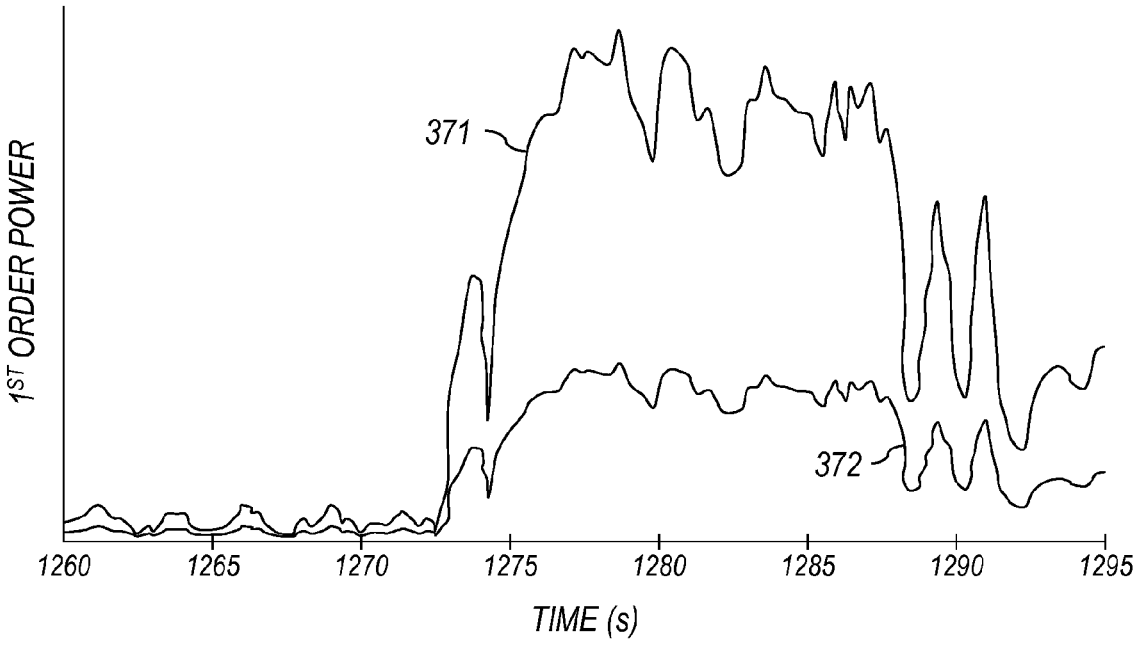

FIG. 11 is a graph including a curve 371 that depicts the power of the first order harmonic, with respect to time, determined utilizing example pressure fluctuation information (such as the information shown in FIG. 10) collected from the pressure sensor 306 associated with a defective one of the pumps 202. FIG. 11 also includes a curve 372 that depicts the power of the first order harmonic determined utilizing example pressure fluctuation information (such as may be similar to the information shown in FIG. 10) collected from the pressure sensor 306 associated with a healthy one of the pumps 202. The curves 371 and 372 depict the powers of the first order harmonic of both pumps 202 as being substantially negligible until about the time of 1272 seconds. At that time, one of the pumps 202 has become defective, such that the curves 371 and 372 each depict an appreciable increase in power. However, it is clear that the pump 202 to which the curve 371 corresponds is the defective pump, because the power increase exhibited by the curve 371 is substantially greater than the power increase exhibited by the curve 372. For example, the maximum peak of the curve 371, at about 1278 seconds, is about three times as great as the maximum peak of the curve 372 at the same time. As described above, this difference in power of the first order harmonic is attributable to the fact that the pressure sensor of the defective pump senses the defect-caused pressure fluctuations directly at the defective pump, whereas the defect-caused pressure fluctuations sensed by the pressure sensors of the healthy pumps have become attenuated during their traversal from the defective pump to the healthy pumps.

FIG. 11 could include additional curves depicting the powers of the first order harmonic determined utilizing pressure fluctuation information collected from the other pressure sensors 306 of the remaining pumps 202, although these curves are not shown in FIG. 11 for the sake of clarity. However, assuming for the sake of this example that just one the pumps 202 is defective, while the other pumps 202 are healthy, the additional first order harmonic power curves for the other pumps 202 that are not shown in FIG. 11 would appear similar to the curve 372, at least with respect to having a magnitude substantially less than the curve 371.

Figure 12:
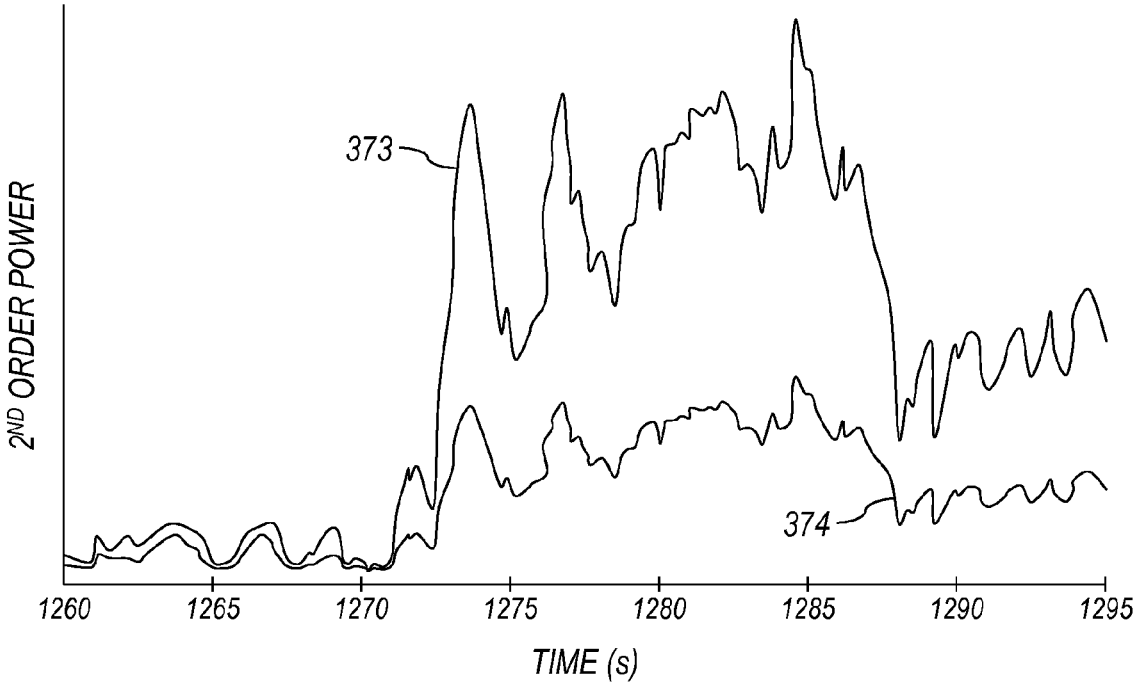

FIG. 12 is a graph including a curve 373 that depicts the power of the second order harmonic, with respect to time, determined utilizing the pressure fluctuation information that was collected from the pressure sensor 306 of the defective pump 202 and utilized to generate the curve 371 of FIG. 11. FIG. 12 also includes a curve 374 that depicts the power of the second order harmonic determined utilizing the pressure fluctuation information that was collected from the pressure sensor 306 of the healthy pump 202 and utilized to generate the curve 372 of FIG. 11. As with FIG. 11, the curves 373 and 374 of FIG. 12 depict the powers of the second order harmonic of both pumps 202 as being substantially negligible until about the time of 1272 seconds. At that time, one of the pumps 202 has become defective, such that the curves 373 and 374 each depict an appreciable increase in power. However, it is clear that the pump 202 to which the curve 373 corresponds is the defective pump, because the power increase exhibited by the curve 373 is substantially greater than the power increase exhibited by the curve 374. For example, the maximum peak of the curve 373, at about 1285 seconds, is about three times as great as the maximum peak of the curve 374 at the same time.

As with FIG. 11, FIG. 12 could include additional curves depicting the powers of the second order harmonic determined utilizing pressure fluctuation information collected from the other pressure sensors 306 of the remaining pumps 202, although these curves are not shown in FIG. 12 for the sake of clarity. However, as above, the additional second order harmonic power curves for the other pumps 202 that are not shown in FIG. 12 would appear similar to the curve 374, at least with respect to having a magnitude substantially less than the curve 373.

Thus, the present disclosure also introduces determining and/or monitoring power of the first and/or second order harmonics to distinguish a defective pump from healthy pumps operating at substantially the same speed. To determine the first and/or second order harmonics power, signal processing may be performed utilizing sensor information collected during a sufficiently long time period so that the frequency resolution may be high enough to permit distinguishing the defective pump from the healthy pumps, and such that the determined power of the harmonics does not appear random in nature. For example, the harmonics power analysis may utilize sensor information collected during a time period that is greater than the time period of one pump stroke. In an example implementation, the harmonics power analysis may utilize sensor information collected during a time period that spans about three pump strokes.

The difference between the powers determined utilizing information from the defective and healthy pumps may not be as large as depicted in the examples shown in FIGS. 11 and 12. For example, the powers of the first and/or second order harmonics determined utilizing the pressure fluctuation information generated by the pressure sensor 306 associated with the defective pump 202 may be about 5% to about 25% greater than the powers of the first and/or second order harmonics determined utilizing the pressure fluctuation information generated by the pressure sensors 306 associated with the healthy pumps 202. As described above, the actual difference between the powers of the first and/or second order harmonics of the healthy and defective pumps 202 may depend upon piping distance between the pumps 202, among other possible factors.

To detect which of the pumps 202 is detective, the harmonic powers associated with each pump 202 may be visually inspected and/or compared by a human operator to identify which of the pumps 202 is associated with the greatest power of the first and/or second harmonics. The controller 310 may also automatically compare the powers of the first and/or second harmonics of each pump 202 to identify which of the pumps 202 is associated with the greatest power, thus identifying which of the pumps 202 is defective.

Although the examples described in association with FIGS. 1-12 describe the pump 202 as being a triplex reciprocating pump comprising three fluid chambers 218 and three reciprocating members 222, other implementations within the scope of the present disclosure may utilize quintuplex reciprocating pumps comprising five fluid chambers and five reciprocating members, or other reciprocating pumps comprising other quantities of fluid chambers and reciprocating members. As long as the pumps comprise at least two fluid chambers, and thus at least two reciprocating members, the powers of the first through $X^{th}$ order harmonics may be compared to identify which of the pumps is defective, wherein X=N−1 and, as described above, N is the number of fluid chambers (and reciprocating members).

The defective pump 202 may also be identified by comparing or tracking phase of the harmonics with time (hereinafter referred to as harmonic information) with respect to pump phase or angular position with time (hereinafter referred to as pump phase information) for each of the pumps 202. Such implementations may be utilized in noisy and/or otherwise non-ideal environments.

The pump phase information for each pump may be generated, such as by the controller 310, utilizing position information received from the rotary sensor 302 associated with that pump 202. The controller 310 may then compare the harmonic information with the pump phase information and generate a graph showing phase difference, phase relationship, and/or phase tracking (hereinafter referred to as phase tracking information) between the harmonic information and the pump phase information. The phase tracking information may be indicative of the defective pump 202. For example, if the phase tracking information shows that the harmonic information and the pump phase information track, or are in phase, the phase tracking information may be indicative of the defective pump 202. Such technique or method may provide higher robustness in detecting the defective pump among the healthy pumps when the defective and healthy pumps are operating at substantially similar frequencies.

The phase tracking information may also provide additional resolution that may aid in identifying which component or portion of the defective pump 202, such as which reciprocating member 222 and/or valve 228, 236, may be defective. For example, in a triplex pump, such as the pump 202, the three reciprocating members 222 are at a 120 degrees phase difference relative to each other. Thus, if the absolute rotational position of the drive shaft 252 due to a mechanically fixed phase relationship between the various portions of the pump 202 is known, then phase tracking of the defective portion of the defective pump 202 may be achieved. For example, if the harmonic information and the pump phase information track at 120 degrees, and if the mechanical relationship between the various portions of the pump 202 provides that a second outlet valve 236 opens up to discharge the pressurized fluid from a second (i.e., central) fluid chamber 218 at the pump phase of 120 degrees, then the failure may be determined to have occurred at the second outlet valve 236 associated with the second fluid chamber 218.

Unlike when determining the harmonics power, when digital signal processing is performed utilizing sensor information collected during the longer time period described above (e.g., three pump strokes), the determined phase tracking information may substantially fluctuate or appear random in nature. Such result may be caused by instantaneous variation in the speed of the pumps, which may skew the phase tracking information. Therefore, whether instead of or in addition to comparing the harmonics powers to identify the defective pump, sensor information collected during a shorter time period, such as the time period of one pump stroke or less, may be utilized to compare or track the phase of the harmonic information with respect to the pump phase information.

Figure 13:
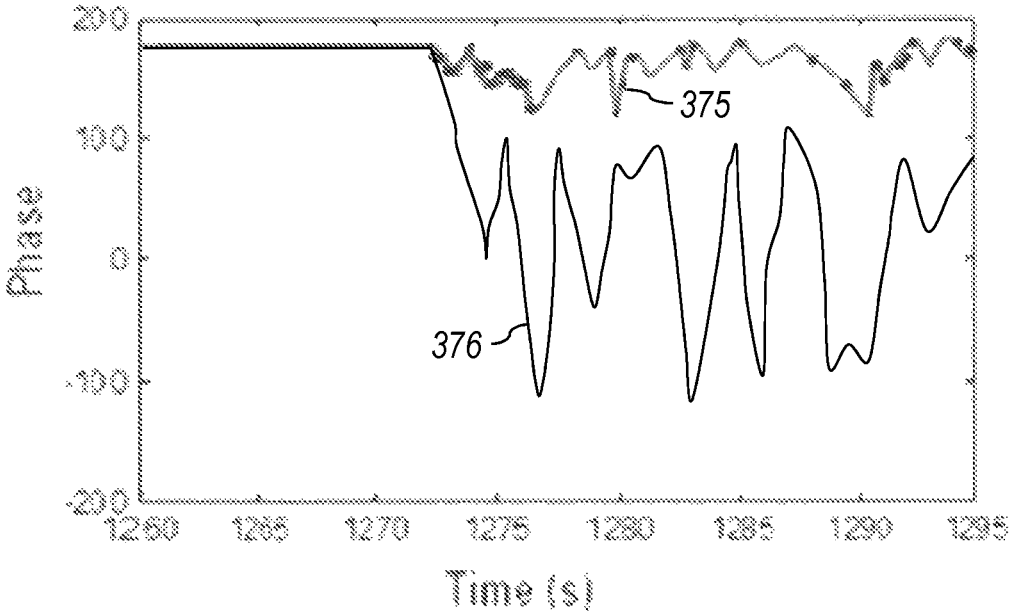

FIG. 13 is a graph having a curve 375 depicting example phase tracking information (in degrees) of the first order harmonic information associated with a defective pump with respect to pump phase information of the defective pump. Between the time of 1260 seconds and about 1272 seconds, which is the time at which the defective pump became defective, the curve 375 depicts the harmonic information and the pump phase information being in phase, or tracking. Thereafter, although slight variation exists, the curve 375 depicts the harmonic information and the pump phase information continuing to be substantially in phase or tracking.

FIG. 13 also includes a curve 376 depicting example phase tracking information of the first order harmonic information associated with a healthy pump with respect to pump phase information of the healthy pump. As with the curve 375, between the time of 1260 seconds and about 1272 seconds, the curve 376 depicts the harmonic information and the pump phase information being in phase, or tracking. Thereafter, the curve 376 depicts the harmonic information and the pump phase information being substantially out of phase, or not tracking. That is, at about 1272 seconds, the curve 376 substantially fluctuates, to a magnitude about five times greater than the fluctuation of the curve 375, and/or otherwise appears random in nature. The substantially lesser degree to which the harmonic information and the pump phase information are out of phase may thus be utilized to identify the defective pump, because the harmonic information and the pump phase information for the healthy pumps will appear substantially out of phase. It is also noted that implementations within the scope of the present disclosure may also include such assessment of phase tracking information of the second, third, and/or $X^{th}$ (N−1) order harmonics information associated with the pumps with respect to pump phase information of the pumps.

The phase tracking information may be visually examined and/or compared by a human operator to determine if the harmonic information and the pump phase information are substantially in phase or tracking for each pump. The controller 310 may also automatically examine and/or compare the harmonic information and the pump phase information to identify which of the pumps is defective.

Figure 14:
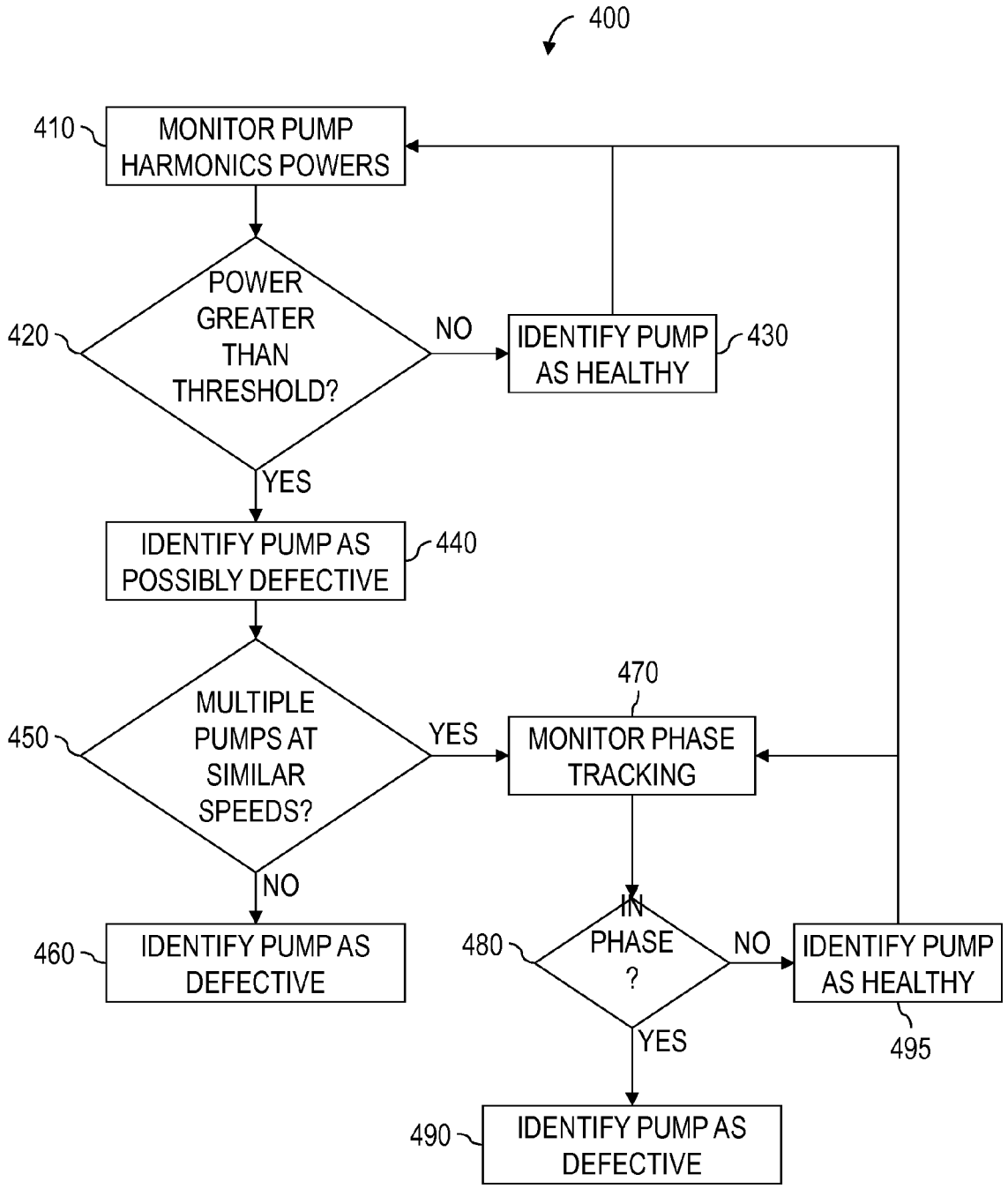
FIG. 14 is a flow-chart diagram of at least a portion of an example implementation of a method according to one or more aspects of the present disclosure.

FIG. 14 is a flow-chart diagram of at least a portion of an example implementation of a method (400) according to one or more aspects of the present disclosure. The method (400) may be performed in conjunction with and/or utilizing at least a portion of one or more implementations of the apparatus shown in one or more of FIGS. 1-5 and/or otherwise within the scope of the present disclosure, and may implement one or more aspects described above with respect to FIGS. 6-13 and/or otherwise introduced by the present disclosure.

The method (400) comprises monitoring (410) powers of first, second, and/or other order harmonics, other than the above-described $M^{th}$ order harmonics, of a pump of a pumping system, such as one of the pumps 202 of the pumping system 100 shown in FIG. 1. The pump for which the powers are monitored (410) is referred to below as the monitored pump.

The monitored (410) powers are then compared (420) to a predetermined threshold. If the monitored (410) powers are determined (420) to not be greater than the threshold, then the monitored pump may be identified (430) as healthy, and monitoring (410) the pump harmonics powers may continue. If one of the monitored (410) powers is determined (420) to be greater than the threshold, then the monitored pump is identified (440) as possibly being defective.

The method (400) may then comprise determining (450) whether the pumping system comprises multiple pumps that are operating at substantially the same speed, frequency, or harmonic. If it is determined (450) that there are no pumps operating at substantially the same speed, frequency, or harmonic, the monitored pump is identified (460) as being the one pump in the pumping system that is defective.

If it is determined (450) that there are multiple pumps operating at substantially the same speed, frequency, or harmonic, phase tracking between the above-described harmonic information and pump phase information is monitored (470) for each pump operating at substantially the same speed, frequency, or harmonic. If the harmonic information and the pump phase information are then determined (480) to be substantially in phase or tracking, the monitored pump is identified (490) as being defective. If the harmonic information and the pump phase information are determined (480) to not be substantially in phase or tracking, the monitored pump is identified (495) as being healthy. The phase tracking of the monitored pump may then continue to be monitored (470), and/or the monitored pump harmonics powers may continue to be monitored (410). The identification (495) of the monitored pump as being healthy also indicates that a defect exists with one of the other pumps operating at substantially the same speed, frequency, or harmonic as the monitored pump.

In view of the entirety of the present disclosure, including the figures and the claims, a person having ordinary skill in the art should readily recognize that the present disclosure introduces an apparatus comprising: a monitoring system operable for detecting pump defects in a pumping system comprising a plurality of pumps, wherein each of the plurality of pumps comprises a pump fluid outlet, wherein the pump fluid outlets are fluidly connected, and wherein the monitoring system comprises: a plurality of pressure sensors each associated with a corresponding one of the plurality of pumps, wherein each of the plurality of pressure sensors is operable to generate information related to fluid pressure at a corresponding pump fluid outlet; and a monitoring device in communication with the plurality of pressure sensors, wherein the monitoring device is operable to determine harmonic frequencies from the information related to fluid pressure for each of the plurality of pumps, and wherein amplitude of the harmonic frequencies is indicative of a defective one of the plurality of pumps.

Relative amplitude of the harmonic frequencies of the plurality of pumps may be indicative of the defective one of the plurality of pumps. Greatest amplitude of the harmonic frequencies of the plurality of pumps may also or instead be indicative of the defective one of the plurality of pumps.

The amplitude of the harmonic frequencies associated with the defective one of the plurality of pumps may be greater than the amplitude of the harmonic frequencies associated with another of the plurality of pumps. The amplitude of the harmonic frequencies associated with the defective one of the plurality of pumps may be between about 5% and about 25% greater than the amplitude of the harmonic frequencies associated with another of the plurality of pumps.

The monitoring device may be operable to determine the amplitude of first order harmonic frequency from the information related to fluid pressure for each of the plurality of pumps. In such implementations, among others within the scope of the present disclosure, the amplitude of the first order harmonic frequency may be indicative of the defective one of the plurality of pumps.

At least one of the plurality of pumps may comprise N fluid displacing members, wherein N is an integer equal to at least 2, and the monitoring device may be operable to determine the amplitude of N−1 order harmonic frequency from the information related to fluid pressure for each of the plurality of pumps. In such implementations, among others within the scope of the present disclosure, the amplitude of the N−1 order harmonic frequency may be indicative of the defective one of the plurality of pumps. The fluid displacing members may comprise pistons, plungers, or diaphragms.

The monitoring system may further comprise a plurality of position sensors each associated with a corresponding one of the plurality of pumps. The plurality of position sensors ma comprise one or more of an encoder, a rotational position sensor, a rotational speed sensor, a proximity sensor, and/or a linear position sensor. Each of the plurality of position sensors may be operable to generate information related to phase of the corresponding one of the plurality of pumps, and the monitoring device may be further operable to determine a relationship between phase of the harmonic frequency and the information related to phase for each of the plurality of pumps, wherein the relationship may be indicative of the defective one of the plurality of pumps. A substantially close and/or continuous relationship between the phase of the harmonic frequency and the information related to phase may be indicative of the defective one of the plurality of pumps. A value of the phase of the harmonic frequency and the information related to phase having the substantially close and/or continuous relationship may be indicative of which portion of the defective one of the plurality of pumps is defective. A substantially changing, fluctuating, and/or random relationship between phase of the harmonic frequency and the information related to phase may be indicative of a healthy one of the plurality of pumps. The relationship may comprise phase difference, phase relationship, and/or phase tracking. A substantially close and/or continuous phase relationship and/or phase tracking between phase of the harmonic frequency and the information related to phase may be indicative of the defective one of the plurality of pumps.

The plurality of pumps may comprise a plurality of multiplex positive displacement pumps. The defective one of the plurality of pumps may comprise a failed pump, a failing pump, and/or a pump comprising a leaking fluid inlet valve, a leaking fluid outlet valve, a leaking seal, an improperly primed fluid chamber, or a combination thereof.

The present disclosure also introduces a method comprising: detecting pump defects in a pumping system comprising a plurality of pumps, wherein each of the plurality of pumps comprises a pump fluid outlet, wherein the pump fluid outlets are fluidly connected, and wherein detecting pump defects comprises: generating information related to fluid pressure fluctuations at each pump fluid outlet; and determining harmonic frequencies from the information related to fluid pressure fluctuations for each of the plurality of pumps, wherein the amplitude of the harmonic frequencies is indicative of a defective one of the plurality of pumps.

Relative amplitude of the harmonic frequencies of the plurality of pumps may be indicative of the defective one of the plurality of pumps. Greatest amplitude of the harmonic frequencies of the plurality of pumps may also or instead be indicative of the defective one of the plurality of pumps.

The amplitude of the harmonic frequencies associated with the defective one of the plurality of pumps may be greater than the amplitude of the harmonic frequencies associated with another of the plurality of pumps. The amplitude of the harmonic frequencies associated with the defective one of the plurality of pumps may be between about five % and about 25% greater than the amplitude of the harmonic frequencies associated with another of the plurality of pumps.

Detecting pump defects may further comprise: determining amplitude of harmonic frequencies for each of the plurality of pumps; and comparing the amplitudes of the harmonic frequencies for each of the plurality of pumps to determine the defective one of the plurality of pumps. In such implementations, among others within the scope of the present disclosure, determining the amplitude of the harmonic frequencies may comprise determining the amplitude of first order harmonic frequency from the information related to fluid pressure fluctuations for each of the plurality of pumps, and the amplitude of the first order harmonic frequency may be indicative of the defective one of the plurality of pumps. At least one of the plurality of pumps may comprise N fluid displacing members, wherein N is an integer equal to at least 2. The fluid displacing members may comprise pistons, plungers, or diaphragms. Determining the amplitude of the harmonic frequencies may comprise determining the amplitude of N−1 order harmonic frequency from the information related to fluid pressure fluctuations for each of the plurality of pumps, and the amplitude of the N−1 order harmonic frequency may be indicative of the defective one of the plurality of pumps.

Detecting pump defects may further comprise: generating information related to phase of each of the plurality of pumps; and determining a relationship between phase of the harmonic frequency and the information related to phase for each of the plurality of pumps, wherein the relationship may be indicative of the defective one of the plurality of pumps. A substantially close and/or continuous relationship between phase of the harmonic frequency and the information related to phase may be indicative of the defective one of the plurality of pumps. The relationship may comprise phase difference, phase relationship, and/or phase tracking. A substantially changing, fluctuating, and/or random relationship between phase of the harmonic frequency and the information related to phase may be indicative of a healthy one of the plurality of pumps. The information related to phase may be generated by a plurality of position sensors, such as may comprise one or more of an encoder, a rotational position sensor, a rotational speed sensor, a proximity sensor, and/or a linear position sensor.

Determining harmonic frequencies from the information related to fluid pressure fluctuations may comprise converting the information related to fluid pressure fluctuations from time domain to frequency domain.

The plurality of pumps may comprise a plurality of multiplex positive displacement pumps. The defective one of the plurality of pumps may comprise a failed pump, a failing pump, and/or a pump comprising a leaking fluid inlet valve, a leaking fluid outlet valve, a leaking seal, an improperly primed fluid chamber, or a combination thereof.

The present disclosure also introduces a method comprising: detecting pump defects in a pumping system comprising at least one multiplex positive displacement pump, wherein the at least one pump comprises a pump fluid outlet, and wherein detecting pump defects comprises: monitoring fluid pressure fluctuations at the pump fluid outlet of the at least one pump; determining harmonics for the at least one pump based on fluid pressure fluctuations; and monitoring amplitude of the harmonics for the at least one pump to determine if the at least one pump is defective.

The at least one pump may comprise N fluid displacing members, wherein N is an integer equal to at least 2. In such implementations, monitoring the amplitude of the harmonics for the at least one pump may comprise monitoring the amplitude of first order harmonics and/or N−1 order harmonics for the at least one pump.

Detecting pump defects may further comprise: determining if the amplitude of the harmonics for the at least one pump is greater than a threshold value; if the amplitude of the harmonics is greater than the threshold value, identifying the at least one pump as defective; and if the amplitude of the harmonics is not greater than the threshold value, identifying the at least one pump as healthy. In such implementations, among others within the scope of the present disclosure, detecting pump defects may further comprise: determining if the pumping system comprises a plurality of pumps operating at same or similar frequency; and if the pumping system comprises a plurality of pumps operating at the same or similar frequency: monitoring phase of the harmonics for each of the plurality of pumps; monitoring pump phase of each of the plurality of pumps; and comparing phase of the harmonics with respect to pump phase for each of the plurality of pumps to determine a defective one of the plurality of pumps. In such implementations, among others within the scope of the present disclosure, detecting pump defects may further comprise: determining if the phase of the harmonics and pump phase of each of the plurality of pumps are substantially in phase or tracking; if the phase of the harmonics and pump phase of one or more of the plurality of pumps are substantially in phase or tracking, identifying the one or more of the plurality of pumps as healthy; and if the phase of the harmonics and the pump phase of the one or more of the plurality of pumps are not substantially in phase or tracking, identifying the one or more of the plurality of pumps as defective.

The defective pump may comprise a failed pump, a failing pump, and/or a pump comprising a leaking fluid inlet valve, a leaking fluid outlet valve, a leaking seal, an improperly primed fluid chamber, or a combination thereof.

The foregoing outlines features of several embodiments so that a person having ordinary skill in the art may better understand the aspects of the present disclosure. A person having ordinary skill in the art should appreciate that they may readily use the present disclosure as a basis for designing or modifying other processes and structures for carrying out the same functions and/or achieving the same benefits of the embodiments introduced herein. A person having ordinary skill in the art should also realize that such equivalent constructions do not depart from the spirit and scope of the present disclosure, and that they may make various changes, substitutions and alterations herein without departing from the spirit and scope of the present disclosure.

The Abstract at the end of this disclosure is provided to comply with 37 C.F.R. §1.72(b) to permit the reader to quickly ascertain the nature of the technical disclosure. It is submitted with the understanding that it will not be used to interpret or limit the scope or meaning of the claims.

What is claimed is:

1. A method, comprising:

detecting pump defects in a pumping system comprising a plurality of pumps, wherein each of the plurality of pumps comprises a pump fluid outlet, wherein each of the pump fluid outlets is fluidly connected to a common manifold, and wherein detecting pump defects comprises:

generating information related to fluid pressure fluctuations at each of the pump fluid outlets; and determining harmonic frequencies from the information related to fluid pressure fluctuations for each of the plurality of pumps, wherein the amplitude of the harmonic frequencies is indicative of a defective one of the plurality of pumps.

2. The method of claim 1 wherein relative amplitude of the harmonic frequencies of the plurality of pumps is indicative of the defective one of the plurality of pumps.

3. The method of claim 1 wherein greatest amplitude of the harmonic frequencies of the plurality of pumps is indicative of the defective one of the plurality of pumps.

4. The method of claim 1 wherein the amplitude of the harmonic frequencies associated with the defective one of the plurality of pumps is greater than the amplitude of the harmonic frequencies associated with another of the plurality of pumps.

5. The method of claim 1 wherein detecting pump defects further comprises:

determining amplitude of harmonic frequencies for each of the plurality of pumps; and comparing the amplitudes of the harmonic frequencies for each of the plurality of pumps to determine the defective one of the plurality of pumps.

6. The method of claim 5 wherein determining the amplitude of the harmonic frequencies comprises determining the amplitude of first order harmonic frequency from the information related to fluid pressure fluctuations for each of the plurality of pumps, and wherein the amplitude of the first order harmonic frequency is indicative of the defective one of the plurality of pumps.

7. The method of claim 5 wherein at least one of the plurality of pumps comprises N fluid displacing members, wherein N is an integer equal to at least 2, wherein determining the amplitude of the harmonic frequencies comprises determining the amplitude of N−1 order harmonic frequency from the information related to fluid pressure fluctuations for each of the plurality of pumps, and wherein the amplitude of the N−1 order harmonic frequency is indicative of the defective one of the plurality of pumps.

8. The method of claim 1 wherein detecting pump defects further comprises:

generating information related to phase of each of the plurality of pumps; and determining a relationship between phase of the harmonic frequency and the information related to phase for each of the plurality of pumps, wherein the relationship is indicative of the defective one of the plurality of pumps.

9. The method of claim 8 wherein a substantially close and/or continuous relationship between phase of the harmonic frequency and the information related to phase is indicative of the defective one of the plurality of pumps.

10. The method of claim 8 wherein the relationship comprises phase difference, phase relationship, and/or phase tracking.

11. The method of claim 8 wherein a substantially changing, fluctuating, and/or random nature of the relationship is indicative of a healthy one of the plurality of pumps.

12. The method of claim 1 wherein determining harmonic frequencies from the information related to fluid pressure fluctuations comprises converting the information related to fluid pressure fluctuations from time domain to frequency domain.

13. An apparatus, comprising:

a monitoring system operable for detecting pump defects in a pumping system comprising a plurality of pumps, wherein each of the plurality of pumps comprises a pump fluid outlet, wherein each of the pump fluid outlets is fluidly connected to a common manifold, and wherein the monitoring system comprises:

a plurality of pressure sensors each associated with a corresponding one of the plurality of pumps, wherein each of the plurality of pressure sensors is operable to generate information related to fluid pressure at each of the corresponding pump fluid outlets; and a monitoring device in communication with each of the plurality of pressure sensors, wherein the monitoring device is operable to determine harmonic frequencies from the information related to fluid pressure for each of the plurality of pumps, and wherein amplitude of the harmonic frequencies is indicative of a defective one of the plurality of pumps.

14. The apparatus of claim 13 wherein at least one of the plurality of pumps comprises N fluid displacing members, wherein N is an integer equal to at least 2, wherein the monitoring device is operable to determine the amplitude of N−1 order harmonic frequency from the information related to fluid pressure for each of the plurality of pumps, and wherein the amplitude of the N−1 order harmonic frequency is indicative of the defective one of the plurality of pumps.

15. The apparatus of claim 13 wherein:

the monitoring system further comprises a plurality of position sensors each associated with a corresponding one of the plurality of pumps;

each of the plurality of position sensors is operable to generate information related to phase of the corresponding one of the plurality of pumps;

the monitoring device is further operable to determine a relationship between phase of the harmonic frequency and the information related to phase for each of the plurality of pumps; and the relationship is indicative of the defective one of the plurality of pumps.

16. A method, comprising:

detecting pump defects in a pumping system comprising at least one two multiplex positive displacement pumps, wherein each of the pumps comprises a pump fluid outlet, and wherein detecting pump defects comprises:

monitoring fluid pressure fluctuations at each of the pump fluid outlets;

determining harmonics for at least one of the pumps based on fluid pressure fluctuations; and monitoring amplitude of the harmonics for at least one of the pumps to determine if at least one of the pumps is defective.

17. The method of claim 16 wherein at least one of the pumps comprises N fluid displacing members, wherein N is an integer equal to at least 2, and wherein monitoring the amplitude of the harmonics for at least one of the pumps comprises monitoring the amplitude of first order harmonics and/or N−1 order harmonics for at least one of the pumps.

18. The method of claim 16 wherein detecting pump defects further comprises:

determining if the amplitude of the harmonics for at least one of the pumps is greater than a threshold value;

if the amplitude of the harmonics is greater than the threshold value, identifying at least one of the pumps as defective; and if the amplitude of the harmonics is not greater than the threshold value, identifying at least one of the pumps as healthy.

19. The method of claim 18 wherein detecting pump defects further comprises:

determining if the pumping system comprises a plurality of pumps operating at same or similar frequency; and if the pumping system comprises a plurality of pumps operating at the same or similar frequency:

monitoring phase of the harmonics for each of the plurality of pumps;

monitoring pump phase of each of the plurality of pumps; and comparing phase of the harmonics with respect to pump phase for each of the plurality of pumps to determine a defective one of the plurality of pumps.

20. The method of claim 19 wherein detecting pump defects further comprises:

determining if the phase of the harmonics and pump phase of each of the plurality of pumps are substantially in phase or tracking;

if the phase of the harmonics and pump phase of one or more of the plurality of pumps are substantially in phase or tracking, identifying the one or more of the plurality of pumps as healthy; and if the phase of the harmonics and the pump phase of the one or more of the plurality of pumps are not substantially in phase or tracking, identifying the one or more of the plurality of pumps as defective.

* * * * *